US006164020A

United States Patent [19]

Nitch

[11] Patent Number: 6,164,020

[45] Date of Patent: Dec. 26, 2000

[54] ROOF GUTTER GUARD

[76] Inventor: Stephen J. Nitch, 622 Ellington Ct., Fox River Grove, Ill. 60021

[21] Appl. No.: 09/218,674

[22] Filed: Dec. 22, 1998

[51] Int. Cl.[7] ..... E04D 13/00

[52] U.S. Cl. ..... 52/12; 52/11; 52/94; 52/660

[58] Field of Search ..... 52/11, 12, 94, 52/660

[56] References Cited

U.S. PATENT DOCUMENTS

| | | | |
|---|---|---|---|
| 1,770,017 | 7/1930 | Sommer | 52/660 |
| 2,271,081 | 1/1942 | Layton . | |
| 2,542,155 | 2/1951 | Moller | 52/12 |
| 3,067,881 | 12/1962 | Goosmann | 52/12 |
| 3,388,555 | 6/1968 | Foster . | |
| 4,036,761 | 7/1977 | Rankin . | |
| 4,411,110 | 10/1983 | Rankin . | |
| 4,745,710 | 5/1988 | Davis . | |
| 4,769,957 | 9/1988 | Knowles . | |
| 4,876,827 | 10/1989 | Williams . | |
| 4,965,969 | 10/1990 | Antenen . | |
| 5,257,482 | 11/1993 | Sichel . | |
| 5,321,920 | 6/1994 | Sichel . | |
| 5,406,754 | 4/1995 | Cosby . | |
| 5,727,350 | 3/1998 | Marcella | 52/12 |

*Primary Examiner*—Christopher T. Kent
*Assistant Examiner*—Jennifer I. Thissell
*Attorney, Agent, or Firm*—Meroni & Meroni; Charles F. Meroni, Jr.

[57] ABSTRACT

A gutter screen for preventing the accumulation of debris within a gutter is disclosed. The gutter screen has a plurality of ribs positioned to run transversely across the gutter. Each rib has a rounded first top section, the first top section having a top surface emanating circumferentially about the first top section, a V-shaped first bottom section, a first end, and a second end. The gutter screen also has a plurality of bars positioned to ran above and generally parallel to the gutter. The bars have a rounded second top section and a V-shaped second bottom section. The second top section of each bar is attached to and interconnects the first bottom sections of each rib, the ribs and the bars defining a plurality of gutter screen apertures. A roof flange for attaching the gutter screen underneath a roof shingle extends from the first end of each rib. The roof flange has a roof flange surface which is flush with the top surface of the rib. A L-shaped gutter flange for engaging a gutter edge extends transversely and interconnectingly across each rib just below the first top section at the second end of each rib.

23 Claims, 2 Drawing Sheets

ROOF GUTTER GUARD

BACKGROUND OF THE INVENTION

1. Field of the Invention

The present invention relates to a screening device for preventing the accumulation of leaves and debris from rain gutters.

2. Description of the Prior Art

Gutter screens have been used previously in order to prevent the accumulation of leaves and debris in a gutter while allowing for the flow of rainwater into the gutter. There are a variety of gutter screens in the prior art. The prior art has been largely ineffective due to their inability to prevent the accumulation of debris in the gutter screen itself, or their inability to prevent a large amount of water from flowing over the gutter, or their inability to do both functions. In the prior art, the gutter screen openings where the focus on which innovation was based. As a result, gutter screens have come with a variety of different screen openings.

Generally, gutter screens with larger gutter screen openings allow more water to flow into the gutter and gutter screens with smaller gutter screen openings generally tend to do a better job of preventing leaves and debris from being ensnared on the gutter screen.

The gutter screens with the larger gutter screen openings tend to have a problem with leaves and debris becoming ensnared on the gutter screen. The leaves and debris which become ensnared on the gutter screens block the gutter screen openings preventing the passage of water into the gutter. Consequently, gutter screens with larger screen openings tend to require periodic cleaning more frequently.

Gutter screens with the smaller gutter screen openings generally allow too much water to bypass the gutter and flow over the edge of the gutter. During heavy rainfall, the smaller gutter screen openings are either not able to divert enough water into the gutter or are not able to handle the heavy flow of water entering into the gutter screen openings. Consequently, water flows over the gutter screen and onto the side of the building defeating the purpose of the gutter.

Wherein the prior art has focused on the design of the gutter screen openings in order find overall improvement in gutter screen efficacy, there has been generally little innovation on the design of the structural components such as the bars or ribs which comprise the gutter screen. Consequently, improvement in the efficacy of gutter screens can be achieved through the development of improvements in the design of the structural components that comprise the gutter screen.

Accordingly, there is a need for an inexpensive gutter screen which can minimize the accumulation of leaves and debris in the gutter and on the screen.

Accordingly, there is also a need for an inexpensive gutter screen that can maximize the amount of water that enter the gutter even during a heavy rainfall.

The present invention is a gutter screen with a unique structure which guides water into the gutter while minimizing the amount of leaves and debris which can be entrapped onto the screen. As will be described in greater detail hereinafter, the present invention solves the aforementioned and employs a number of novel features that render it highly advantageous over the prior art.

SUMMARY OF THE INVENTION

Accordingly it is an object of this invention to provide a gutter screen that will minimize the amount of debris which enter the gutter or gets entrapped on the gutter screen.

It is a further object of this invention to provide a gutter screen that will maximize the amount of water that enter the gutter.

Also, a further object of this invention is to provide a gutter screen that is inexpensive to manufacture and package.

To achieve this objective, and in accordance with the purposes of the present invention a gutter screen for preventing the accumulation of debris within a gutter is proposed.

The gutter screen has a plurality of ribs positioned to run transversely across the gutter. Each rib has a rounded first top section, the first top section having a top surface emanating circumferentially about the first top section, a V-shaped first bottom section, a first end, and a second end.

The gutter screen also has a plurality of bars positioned to run above and generally parallel to the gutter. The bars have a rounded second top section and a V-shaped second bottom section. The second top section of each bar is attached to and interconnects the first bottom sections of each rib, the ribs and the bars defining a plurality of gutter screen apertures.

A roof flange for attaching the gutter screen underneath a roof shingle extends laterally from the first end of each rib, interconnecting each rib. The roof flange has a roof flange surface which is connected flush with the top surface of each rib.

A L-shaped gutter flange for engaging a gutter edge extends transversely and interconnectingly across each rib just below the first top section at the second end of each rib. The gutter flange provides a means for attaching the gutter screen to the gutter, and serves to direct the flow of water on the underside of the ribs towards the gutter and away from the gutter edge.

A gutter flange opening is bored through the second end of the rib and through the gutter flange, the gutter flange opening being axially aligned to a gutter hole. A nylon press stud is inserted through the gutter flange opening and through the gutter hole securing the gutter screen to the gutter edge.

The unique shape of the bars and ribs minimize the surface area of the underside of the screen thereby reducing the ability of leaves and twigs to become ensnared with the underside of the gutter screen. The shape of the bars and ribs also decreases the water tension on the underside of the gutter screen decreasing the ability of water to accumulate on the underside of the gutter screen and promoting a siphoning action which pulls water into the gutter.

Furthermore, the unique shape of the ribs allow a small trickle of water to flow unimpeded over the ribs and over the edge of the gutter. This flow of water aids in pushing any leaves or debris lying on the gutter screen over the edge of the gutter.

The gutter screen is made of a synthetic plastic through a molded single piece construction. The plastic construction enables the gutter screens to be relatively lightweight allowing for easier handling during installation and reducing manufacturing and packaging costs.

Other objects, features, and advantages of the invention will become more readily apparent upon reference to the following description when taken in conjunction with the accompanying drawings.

DESCRIPTION OF THE PREFERRED EMBODIMENT

The present invention relates to a gutter screen used to minimize the amount of debris which enter the gutter or gets entrapped on the gutter screen while maximizing the amount of water that enter the gutter. In the following description, numerous specific details are set forth in order to provide a thorough understanding of the present invention.

Figure 1:
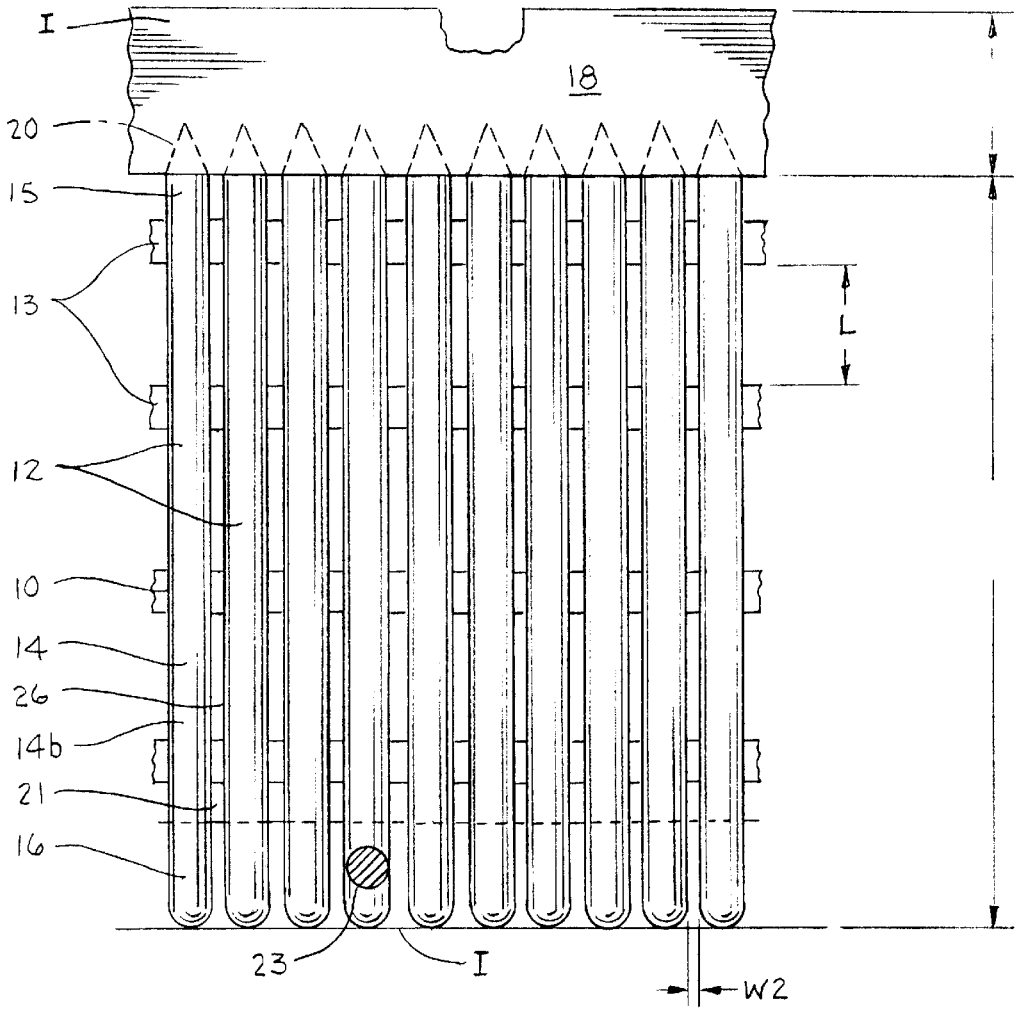
FIG. 1. An is an overhead planar view of the gutter screen illustrating important features.
Figure 2:
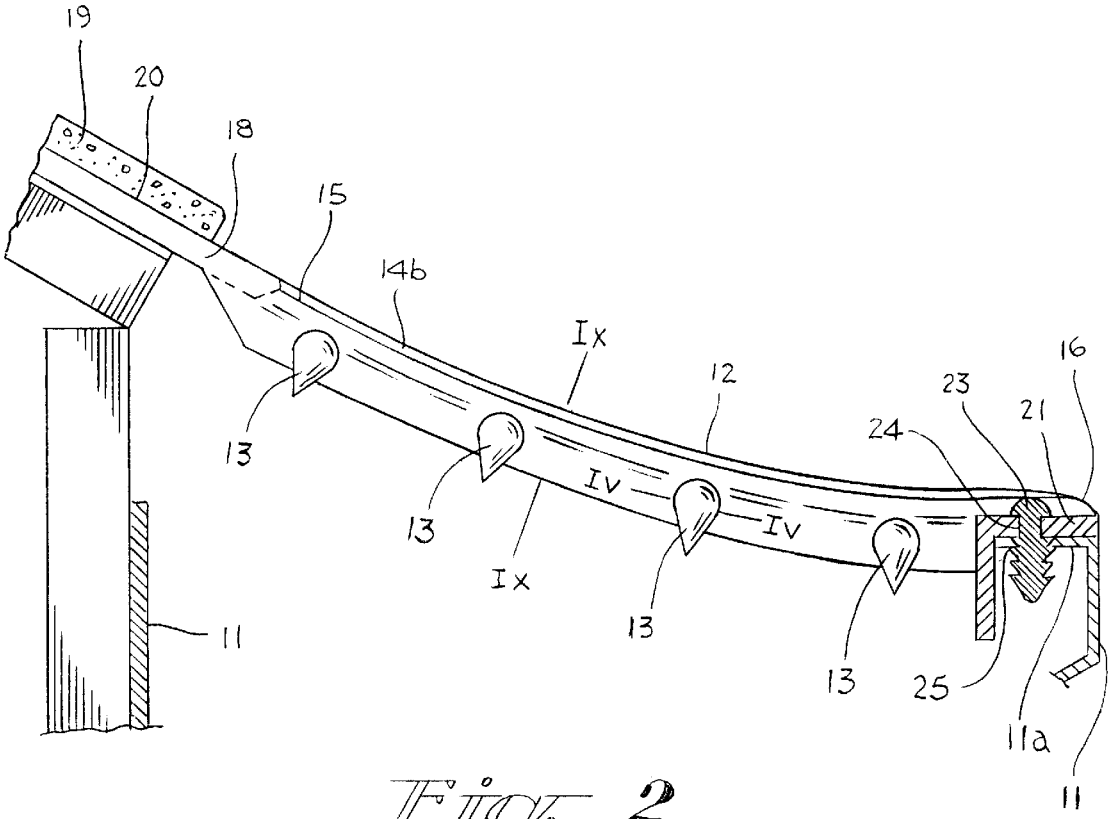
FIG. 2. A cross sectional view of the gutter screen taken along line I—I in FIG. 1.

Referring to FIGS. 1 and 2, a gutter screen is comprised of a plurality of ribs 12 and a plurality of bars 13 arranged in a reticular fashion. In a typical gutter structure, a gutter 11 is mounted along the side of a building just below an overhanging shingle 19 on a roof. A gutter screen generally referred to by the numeral 10, attaches to a roof underneath a shingle 19 transversely crosses a gutter 11 and then attaches to a gutter edge 11 a. The gutter screen 10 has a slope that is roughly parallel to the slope of the roof. The ribs are arranged to run transversely across the gutter 11. The bars 13 are positioned to run generally above and parallel to the gutter 11.

Figure 3:
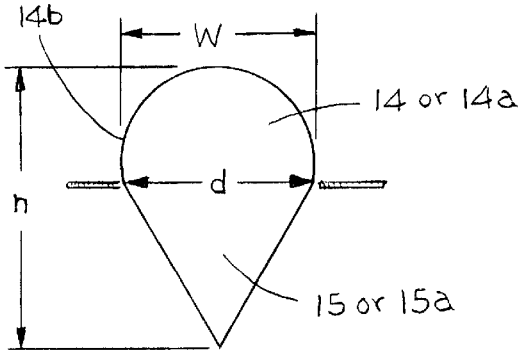
FIG. 3. A cross sectional view of a rib or bar taken along the line I—I in FIG. 1 or IV—IV in FIG. 2.
Figure 4:
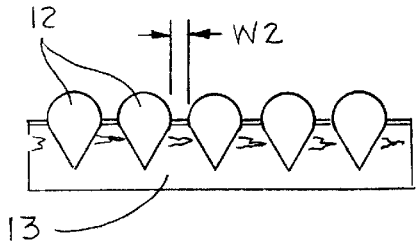
FIG. 4. A cross section view of the ribs taken along the line IX—IX in FIG. 2.

FIG. 3 shows a cross section of a rib 12 or bar 13. In the preferred embodiment, the ribs and the bars both have identical structure and dimensions with the height h of each rib or each bar being at least 7.5 mm, the width w of each bar or rib being at least 5.0 mm. A rounded first top section 14 on each rib or a rounded second top section 14*a* on each bar is preferably semicircular with a diameter d of roughly 5 mm. The first top section has a top surface 14*b* which extends circumferentially around the first top section.

A V-shaped first bottom section 15 and a V-shaped second bottom section 15*a* extends downwardly from the respective first top section and second top section. The first bottom section and the second bottom section both tapering as it projects downward.

Referring to FIGS. 1, 2, 3, and 4 the bars 13 are connected to and interconnect the first bottom sections of each rib. The bars are preferably spaced 30.0 mm apart from each other. The ribs are preferably spaced 2.0 mm apart from each other. As a result, in the preferred embodiment, the ribs and the bars define a plurality of gutter screen apertures 26 having a length L of 30.0 mm and a width W2 of 2.0 mm.

Referring to FIGS. 1 and 2 the ribs each have a first end 15 and a second end 16. A roof flange 18 for attaching the gutter screen underneath a roof shingle extends from the first end of each rib interconnecting each rib. A gutter flange 21 for attaching the gutter screen 10 to a gutter edge 11*a* extends transversely and interconnectingly across each rib just below the first top section at the second end of each rib 12.

The roof flange 18 is a thin elongated strip that is inserted between the roof and the shingle 19 in order to secure the gutter screen 10 to the roof. The unique shape of the roof flange compensates for any inconsistencies in the positioning between the shingle 19 and the gutter 11 allowing water to flow into the gutter 11 even if the gutter is not appropriately positioned under the shingle 19. In the preferred embodiment, the roof flange has a roof flange surface 20 which is connected flush with the top surface 14*b* of each rib at the first end 15, the roof flange extending laterally roughly 8 cm from the first end 15 of each rib 12. Due to the slope of the gutter screen 10, water landing unto the roof flange surface 20 roll unimpeded from the roof flange onto a rib 12 or into the gutter 11.

The gutter flange 21 provides a means for attaching the gutter screen to the gutter edge 11*a*. In the preferred embodiment, the gutter flange 21 is L-shaped with an upper tongue 21*a* and a lower tongue 21*b*. The upper tongue 21*a* runs parallel to and overlays the gutter edge, the upper tongue 21*a* connecting to the second end 16 of each rib 12 just below the first top section. The lower tongue 21*b* extends downwardly from the upper tongue 21 and running generally perpendicular to the gutter edge.

Since the gutter flange is located below the first top section of each rib, the gutter flange 21 does not impede the trickle of water flowing along the first top section 14 of each rib 12. The gutter flange 21 also serves to direct the flow of water on the underside of the ribs towards the gutter 11 and away from the gutter edge 11*a,* the lower tongue 21*b* preventing the flow of water along the underside of the rib 12.

There are a variety of ways to secure the gutter flange 21 to the gutter edge 11*a*. In the preferred embodiment, a gutter flange opening 24 is bore through the second end 16 and through the gutter flange 21, the gutter flange opening 24 being axially aligned to a gutter hole 25. A nylon press stud 23 is inserted through the gutter flange opening 24 and through the gutter hole 25, the nylon press stud securing the gutter screen 10 to the gutter edge 11*a*.

In the preferred embodiment of the gutter screen, a smooth, unimpeded, continuous surface is formed from the roof flange 18 at the first end of the rib to the second end of the rib. The rounded shape of the first top section 14 diverts most of the water which land on the rib 12 or flow onto the rib from the roof flange 12 into the gutter 11, but allows a small trickle of water to flow unimpeded over the ribs and over the gutter edge 11*a*. Leaves or debris lying on the ribs are pushed by this trickle of water over the gutter edge. The overall design of the gutter screen allow the wind, the slope of the gutter screen 10, and the small trickle of water flowing above the first top section to work in conjunction to push any leaves or debris over the edge of the gutter 11 thereby reducing the need to clean the gutter screen.

The V-shape of the first bottom section 15 and the second bottom section 15*a*significantly reduce the surface area on the underside of the gutter screen 10 thereby making it more difficult for leaves and twigs to ensnare themselves onto underside of the gutter screen 10. Furthermore, the V-shape decreases the water tension on the underside of the gutter screen decreasing the ability of water to accumulate on the underside of the gutter screen and promoting a siphoning action which pulls water into the gutter 11.

The gutter screen is preferably made of a flexible synthetic plastic material, but a metallic material such as aluminum can also be used. The use of a synthetic plastic material enables the gutter screen to be manufactured relatively inexpensively through a one piece plastic injection molding process, and it also enables the gutter screen to be relatively lightweight allowing for easier handling and installation of the gutter screens. Furthermore, the lightweight plastic material reduces the shipping as well as packaging costs.

In the preferred embodiment, the gutter screens are 4 feet long and roughly 9 inches wide; however, it is not intended that the present invention be limited thereby. Different dimensions can be used in order to accommodate packaging, manufacturing, or application constraints.

The invention described above is the preferred embodiment of the gutter screen. It is not intended that the novel device be limited thereby. The preferred embodiment may be susceptible to modifications and variations that are within the scope and fair meaning of the accompanying claims and drawings.

I claim:

1. A gutter screen for preventing the accumulation of debris within a gutter comprising:

a plurality of ribs positioned to run transversely across the gutter, each rib having a rounded first top section, the first top section having a top surface emanating circumferentially about the first top section, a V-shaped first bottom section, a first end, and a second end, each rib being 5.0 mm wide and 7.5 mm high;

a plurality of bars positioned to run above and generally parallel to the gutter, the bars having a rounded second top section and a V-shaped second bottom section, each bar being 5.0 mm wide and 7.5 mm high, the second top section of each bar being attached to and interconnecting the first bottom sections of each rib, the ribs and the bars defining a plurality of 30.0 mm long and 2.0 mm wide gutter screen apertures for water penetration therein;

a roof flange for attaching the gutter screen underneath a roof shingle extending laterally, roughly 8 cm from the first end of each rib, interconnecting each rib, the roof flange having a roof flange surface which is flush with the top surface of each rib allowing an unimpeded trickle of water to flow from the roof flange to the second end of each rib;

a L-shaped gutter flange for engaging a gutter edge extends transversely and interconnectingly across each rib just below the first top section at the second end of each rib; and means for securing the gutter flange to a gutter edge.

2. The gutter screen in claim 1 wherein the gutter screen is made of a synthetic plastic material and is of a molded single piece construction.

3. The gutter screen in claim 2 wherein the gutter flange is secured to the gutter edge by a nylon press stud inserted into a gutter flange opening bored through the second end of a rib and through the gutter flange, the gutter flange opening being axially aligned to correspond to a hole located on the gutter edge.

4. The gutter screen in claim 3 wherein the top section of the ribs and the bars are both semicircular with a diameter of at least 5.0 mm.

5. A gutter screen for preventing the accumulation of debris within a gutter comprising:

a plurality of ribs generally positioned to run transversely across the gutter, each rib having a rounded top section, the first top section having a top surface emanating circumferentially about the first top section, a V-shaped bottom section, a first end, and a second end;

a plurality of bars positioned to run above and generally parallel to the gutter, the bars having a rounded second top section and a V-shaped second bottom section, the second top section of each bar being attached to and interconnecting the first bottom section of each rib, the ribs and the bars defining a plurality of apertures for water penetration therein.

6. The gutter screen in claim 5 wherein a roof flange for attaching the gutter screen underneath a roof shingle extends laterally from the first end of each rib interconnecting each rib.

7. The gutter screen in claim 6 wherein a gutter flange for attaching the gutter screen onto a gutter edge extends transversely and interconnectingly across each rib just below the first top section at the second end of each rib.

8. The gutter screen in claim 7 wherein the gutter screen is made of a synthetic plastic material and is of a molded single piece construction.

9. The gutter screen in claim 8 wherein the gutter flange is L-shaped.

10. The gutter screen in claim 9 further comprising a nylon press stud inserted into a gutter flange opening bore through the second end of a rib and through the gutter flange.

11. The gutter screen in claim 10 wherein the ribs and the bars define a plurality of openings roughly 2.0 mm wide by 30.0 mm long.

12. The gutter screen in claim 11 wherein the ribs and the bars are both 5.0 mm wide and 7.5 mm high.

13. The gutter screen in claim 12 wherein the first top section and the second top section are both semicircular with a diameter of at least 5.0 mm.

14. The gutter screen in claim 13 wherein the roof flange has a top surface which is flush with the top surface of the rib allowing an unimpeded trickle of water to flow from the roof flange to the second end of each rib.

15. A gutter screen for preventing the accumulation of debris within a gutter comprising:

a plurality of ribs positioned to run transversely across the gutter, each rib having a rounded first top section, the first top section having a top surface emanating circumferentially about the first top section, a V-shaped first bottom section, a first end, and a second end;

a plurality of bars positioned to run above and generally parallel to the gutter, the bars having a rounded second top section and a V-shaped second bottom section, the second top section of each bar being attached to and interconnecting the first bottom sections of each rib, the ribs and the bars defining a plurality gutter screen apertures for water penetration therein;

a roof flange for attaching the gutter screen underneath a roof shingle extending laterally from the first end of each rib, interconnecting each rib, the roof flange having a roof flange surface which is flush with the top surface of each rib allowing an unimpeded trickle of water to flow from the roof flange to the second end of each rib;

a L-shaped gutter flange for engaging a gutter edge extends transversely and interconnectingly across each rib just below the first top section at the second end of each rib; and means for securing the gutter flange to a gutter edge.

16. In combination, a gutter structure for preventing the accumulation of leaves and debris within a gutter comprising:

a gutter mounted along the side of a building just below an overhanging roof shingle, the gutter having a gutter edge; and a gutter screen comprising:

a plurality of ribs positioned to run transversely across the gutter, each rib having a rounded first top section, the first top section having a top surface emanating circumferentially about the first top section, a V-shaped first bottom section, a first end, and a second end;

a plurality of bars positioned to run above and generally parallel to the gutter, the bars having a rounded second top section and a V-shaped second bottom section, the second top section of each bar being attached to and interconnecting the first bottom sections of each rib, the ribs and the bars defining a plurality of gutter screen apertures for water penetration therein;

a roof flange for attaching the gutter screen underneath a roof shingle extending laterally from the first end of each rib, interconnecting each rib, the roof flange having a roof flange surface which is flush with the top surface of each rib allowing an unimpeded trickle of water to flow from the roof flange to the second end of each rib;

a L-shaped gutter flange for engaging a gutter edge extending transversely and interconnectingly across each rib just below the first top section at the second end of each rib; and means for securing the gutter flange to the gutter edge.

17. The gutter screen in claim 16 wherein the gutter screen is made of a synthetic plastic material and is of a molded single piece construction.

18. The gutter screen in claim 17 wherein the gutter flange is secured to the gutter edge by a nylon press stud inserted into a gutter flange opening bored through the second end of each rib, the gutter flange opening being axially aligned to correspond to a hole located on a gutter edge.

19. The gutter screen in claim 18 wherein the ribs and the bars are both 5.0 mm wide and 7.5 mm high.

20. The gutter screen in claim 19 wherein the first top section and the second top section are both semicircular with a diameter of at least 5.0 mm.

21. The gutter screen in claim 16 wherein the ribs and the bars define a plurality of openings roughly 2.0 mm wide by 30.0 mm long for water penetration therein.

22. A gutter screen for preventing the accumulation of debris within a gutter comprising:

a plurality of ribs positioned to run transversely across the gutter, each rib having a rounded first top section, the first top section having a top surface emanating circumferentially about the first top section, a V-shaped first bottom section, a first end, and a second end;

a plurality of bars positioned to run above and generally parallel to the gutter, the bars having a rounded second top section and a V-shaped second bottom section, the second top section of each bar being attached to and interconnecting the first bottom sections of each rib, the ribs and the bars defining a plurality gutter screen apertures for water penetration therein; and a roof flange for attaching the gutter screen underneath a roof shingle extending laterally from the first end of each rib, interconnecting each rib, the roof flange having a roof flange surface which is flush with the top surface of each rib allowing an unimpeded trickle of water to flow from the roof flange to the second end of each rib.

23. A gutter screen for preventing the accumulation of debris within a gutter comprising:

a plurality of ribs positioned to run transversely across the gutter, each rib having a rounded first top section, the first top section having a top surface emanating circumferentially about the first top section, a V-shaped first bottom section, a first end, and a second end;

a plurality of bars positioned to run above and generally parallel to the gutter, the bars having a rounded second top section and a V-shaped second bottom section, the second top section of each bar being attached to and interconnecting the first bottom sections of each rib, the ribs and the bars defining a plurality gutter screen apertures for water penetration therein; and a L-shaped gutter flange for engaging a gutter edge extends transversely and interconnectingly across each rib just below the first top section at the second end of each rib.

* * * * *